US005273552A

United States Patent [19]

Pozzoli

[11] Patent Number: 5,273,552

[45] Date of Patent: Dec. 28, 1993

[54] PROCESS FOR MULTICOLOR DYEING OF VEGETABLE IVORY PRODUCTS

[76] Inventor: Monica Pozzoli, Via Fermi, 19, Piacenza, Italy, 29100

[21] Appl. No.: 866,182

[22] PCT Filed: Dec. 28, 1990

[86] PCT No.: PCT/EP90/02326

§ 371 Date: Jun. 29, 1992

§ 102(e) Date: Jun. 29, 1992

[87] PCT Pub. No.: WO91/09548

PCT Pub. Date: Jul. 11, 1991

[30] Foreign Application Priority Data

Jan. 2, 1990 [IT] Italy ..... 19001 A/90

[51] Int. Cl.[5] ..... D06P 3/04; A44B 11/25

[52] U.S. Cl. ..... 8/516; 8/517; 24/90 A; 24/90 R

[58] Field of Search ..... 8/516, 517; 24/90

[56] References Cited

U.S. PATENT DOCUMENTS 4,172,702 10/1979 Bernier et al. ..... 8/516

4,251,582 2/1981 Bernier et al. ..... 8/516

FOREIGN PATENT DOCUMENTS 1269706 4/1972 United Kingdom .

*Primary Examiner*—Paul Lieberman

*Assistant Examiner*—William S. Parks

*Attorney, Agent, or Firm*—Lerner, David, Littenberg, Krumholz & Mentlik

[57] ABSTRACT

Buttons or similar products in vegetable ivory undergo a first base dyeing, are then covered in preset areas with a temporary protecting film, and submitted to a second dyeing; the protecting film is eventually removed to obtain a multicolor product.

13 Claims, 1 Drawing Sheet

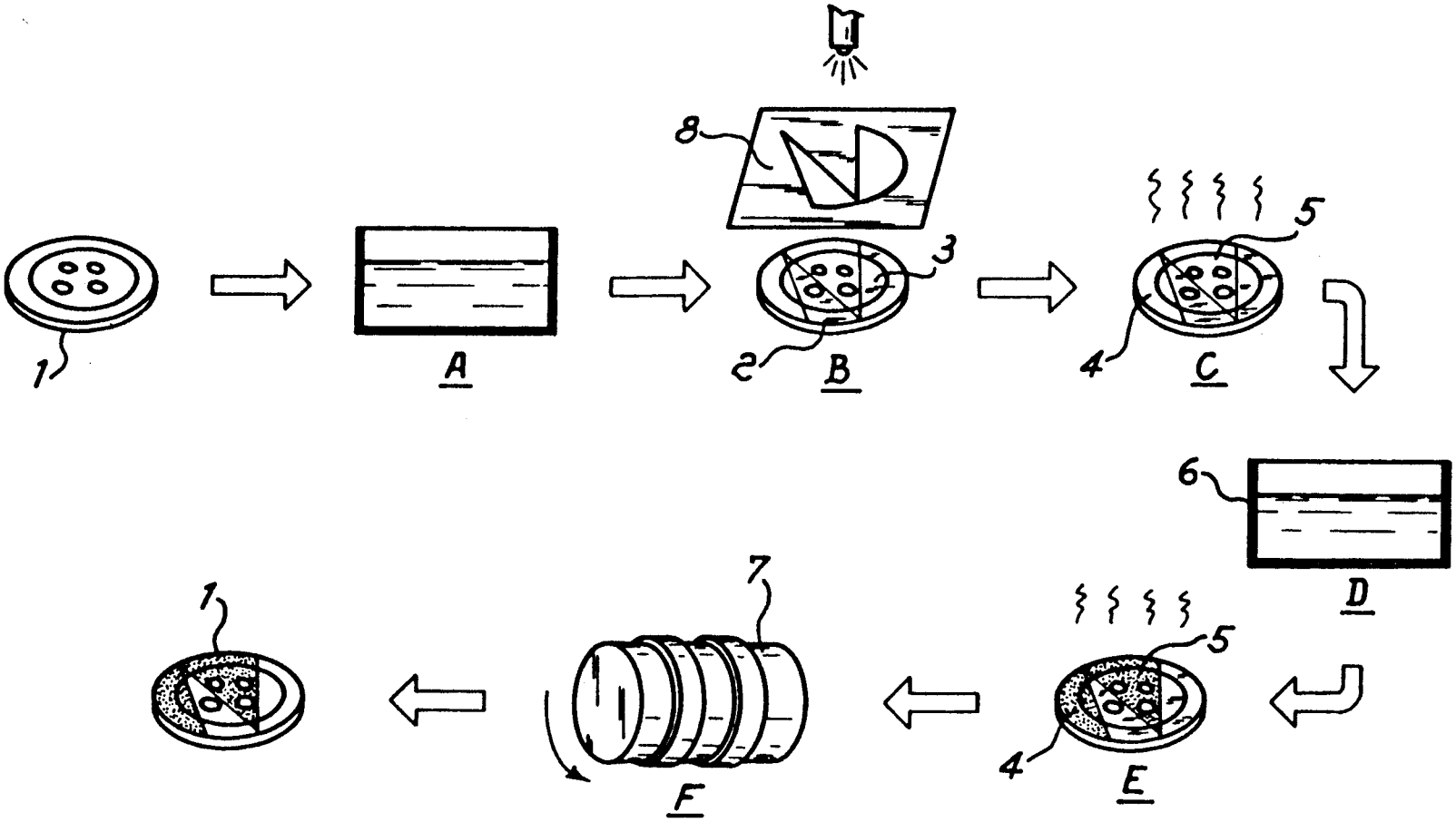
1
A
8
3
2
B
5
4
C
6
D
5
4
E
7
F
1

PROCESS FOR MULTICOLOR DYEING OF VEGETABLE IVORY PRODUCTS

The present invention concerns a process for the multicolor dyeing of items made of vegetable ivory, and namely for the dyeing of buttons made of said material, to which it will be referred to in the present description, without however limiting thereto the scope of the invention.

Vegetable ivory is the preferred raw material for the manufacture of buttons for quality clothing. In fact, though being more economic than nacre, it gives equally satisfactory aesthetic results. Vegetable ivory is constituted by the albumen of the seed of some palms and pandaceae, among which the major ones are those supplying corozo and dum nuts. Vegetable ivory, suitably dried and sliced, is then worked to obtain white buttons which are then dyed in aqueous bath similarly to what occurs for dyeing vegetable textile fibres.

A one-color button is thus easily obtained. Obtaining a multicolor dyeing of the buttons is on the contrary much more difficult.

A known method for manufacturing multicolor buttons envisages to apply one or more dyes to selected areas of the surface of the still "white" button and to dye afterwards the button thus obtained into a bath of a lighter color than those previously applied, the latter ones therefore remaining visible through the last applied dye.

This method has two major drawbacks: first, the originally imparted color of the selected areas is modified by the superimposition of the lighter dye. Secondly, a good fixing of the initially applied color can not be obtained, because said initial color is applied by techniques necessarily different from that of the aqueous bath.

There is therefore the need of a process for the multicolor dyeing of products made of vegetable ivory, and in particular of buttons, which is capable to solve the above reported problems.

Object of the present invention is to provide a dyeing process for vegetable ivory products allowing to dye lastingly said products in several colors in a simple, effective and economic way.

More in particular, the present invention provides a process for the multicolor dyeing of vegetable ivory products, in particular of buttons comprising the following steps:

performing a first soaking treatment in water of said vegetable ivory products;

applying on a plurality of preselected areas of said soaked products surface a solution of a water-insoluble protective resin; evaporating the solvent from said solution until a film for temporarily protecting said areas is obtained; performing a second treatment in water to obtain the dyeing of the non protected areas; fixing the applied dye to said product; and removing said protecting film; the stages of protecting and dyeing being repeated for each desired color besides the base one.

The invention will be now described more in detail with reference to the accompanying FIGURE which shows a block diagram of the process according to the invention.

As shown in said FIGURE, the still "white" vegetable ivory button 1, i.e. still having its natural color and not yet dyed, first undergoes, step A, a treatment in water which, according to different needs, may be an actual dyeing to give a base color to the button, or only constitute a bath in water, should one prefer to maintain said natural ivory white as the base color. In both cases, the wet button impregnates with water and swells, i.e. it undergoes a soaking treatment. The subsequent stage B envisages to apply on preselected areas 2, 3 of the thus wetted (i.e. soaked and possibly dyed) button a solution of water insoluble protective resin. The solution is preferably applied by spraying using stencils which prevent application of the solution to those portions of button 4,5 which are not to be protected.

It is necessary to perform said first treatment in water (stage A) in order to allow the button to swell. In fact the wetted button, at the of a dyeing treatment, is approximately 15% larger than its original size when dry; should the film be applied on the dry button, in former might crack or in any case cover a smaller area than the desired one when the button afterwards is wetted and swells.

In stage C the solvent of the sprayed solution is allowed to evaporate until a film protecting the surface areas 2 and 3 is obtained. This film in fact serves to temporarily protect said areas 2 and 3 from the subsequent dyeing treatment in the bath 6, to which the button is submitted in stage D. At the end of said bath, only the non protected areas 4,5 of the button will have been dyed with the color of bath 6. The button is then left to dry for a time sufficient to allow the dye fixing (stage E). Finally the protecting film is removed by plunging the button into a bath of solvent 7 which dissolves the protective film. In order to accelerate this stage of the process (stage F), the button is submitted to a mechanical action facilitating the dissolution of said film.

The stages of protection and dyeing are repeated for each desired color besides the base one, the base color herein meaning the ivory white of the natural button or the dye applied in the first treatment in water (stage A). For example, a portion of areas 4 or 5 may be on its turn covered with said film of temporary protection and the button thus obtained submitted to a further dyeing bath and to the subsequent removal of the protective film from areas 2,3 and from said portion of areas 4 or 5.

The aforedescribed process requires each dyeing treatment to be performed with a color lighter than that to be applied in the subsequent dyeing treatment, in order to allow the first applied color to be covered by the later applied one.

As mentioned above, the temporary protection film is removed in a solvent bath and, in order to accelerate this step, buttons are submitted to a mechanical action facilitating dissolution and detachment of the film.

It was found that it is possible to obtain excellent results, as far as cleanliness and quickness are concerned, if buttons are treated in a tumbler of the type normally used for their dry polishing, i.e. a tumbler containing wooden dices, in which a sufficient amount of solvent has been introduced; the wooden dices providing the required mechanical action.

The solvent to be used in this stage is obviously related to the type of resin used.

A final drying step is then carried out.

Since films insoluble in water and removable after dyeing have to be obtained, reversible resins soluble in organic solvents are generally adopted. "Reversible resin' as used herein means a resin of the type which can be dissolved by an appropriate solvent even after its polymerization and/or a film is formed on the surface of the button. Preferred classes of resins of this type are natural resins, namely shellac or lac resin, nitrocellulosic resins and polyurethanic resins or mixtures thereof. Since the solution of resin, or resins, is applied on the button after a first treatment in water (stage B), organic solvents, partly compatible with water, are preferably used in order to ensure the solution adherence to the sprayed button even in presence of moisture on the button surface.

Preferred solutions are alcoholic solutions, and particularly ethanol solutions, i.e. solutions wherein the solvent is at least partly consisting of one or more alcohols, preferably ethanol.

A particularly suitable resin solution to be used according to the present invention is an ethanol solution containing 20 to 60% in weight of lac resin.

Said solution preferably consists of a mixture of three parts of a 40% by weight lac solution in ethanol and one part of a lac-containing nitrocellulosic resin, such as for instance the product "Americana scura" or "Americana chiara" by the firm ARRIGONI-SADOLIN s.r.l. LODI (Mich.).

The invention also extends to the aforedescribed solutions as far as their specific use therein is concerned, and to the products thus obtained, both finished and semi-finished products, such as for example buttons provided with a base dye and one or more surface areas protected by a reversible film obtained with a solution and according to a process as the aforedescribed ones.

The invention will not be further disclosed by means of the following non-limitative examples.

EXAMPLE I

A plurality of vegetable ivory buttons, of the polished type, first underwent a base dyeing of beige color by means of an aqueous bath for 30 minutes at 70 C. degrees. At the end of the dyeing bath, selected areas of swollen buttons were sprayed with a solution comprising 75% of a solution of shellac—40% in ethanol—and 25% of Americana chiara. After solvent evaporation and forming of the protecting film, the buttons were again dyed in an aqueous brown dye bath for 20 minutes at 35 C. degrees.

The buttons were then dried at 35 C. degrees for 40 minutes in order to allow complete fixing of the dyes. The dried buttons were put in an alochol containing tumbler, together with a plurality of wooden dices to provide the necessary mechanical action, and herein treated for about 15 minutes, up to complete removal of the protecting film. The final drying step was then carried out; the thus obtained buttons were provided with beige colored areas having sizes and dimensions corresponding to the areas previously temporarily protected by the film, and with alternated, brown colored, areas, without any blurring or smudging.

EXAMPLE II

The same steps as in Example I were carried out, but for the first bath, which was without dye and was effected at 20 C. degrees for 120 minutes. The thus obtained buttons were provided with areas having the color of vegetable ivory alternated with brown colored areas obtained through the second both.

I claim:

1. A process for multicolor dyeing of vegetable ivory products comprising the following steps:

performing a first soaking treatment in water of said vegetable ivory products wherein said products have a base color;

applying a solution of a water-insoluable protective resin to at least one preselected area of said soaked product surface, wherein said product subsequently includes at least one area protected by said resin and at least one area unprotected by said resin;

evaporating the solvent from said solution until a film for temporarily protecting said at least one protected area is obtained;

performing a second treatment in water to obtain the dyeing of said at least one unprotected area;

fixing the applied dye to said product; and removing said protecting film.

2. A process according to claim 1, wherein each dyeing step is performed with a color lighter than that applied in the subsequent dyeing step.

3. A process according to claim 1 or 2, wherein said protective film is removed in solvent-containing polishing tumblers.

4. A process according to claim 1, wherein said solution of protective resins comprises reversible resin selected from the group consisting of nitrocellulosic, natural polyurethanic or mixtures thereof.

5. A process according to claim 4, wherein said solution is an alcoholic solution.

6. A process according to claim 5, wherein said solution is an ethanol solution containing 20 to 60% by weight of lac resin.

7. A process according to claim 6, characterized in that said solution is consisting of a mixture of three parts of an ethanol solution of 40% lac resin and one part of nitrocellulosic lac containing paint.

8. A vegetable ivory multicolor button, as obtained by a process according to claim 1.

9. A method of manufacturing multicolor vegetable ivory products in a process according to claim 1 utilizing a solution consisting of one or more reversible resins selected from the group consisting of nitorcellulosic resins, natural resins, polyurethanic resins and mixtures thereof.

10. A vegetable ivory button, characterized in that it is partially covered by a reversible protective film as obtained by a process according to claim 1.

11. A process according to claim 1 wherein said base color comprises the natural color of said vegetable ivory products.

12. A process according to claim 1 wherein said base color comprises said dye applied to said vegetable ivory product during said first soaking treatment.

13. A process according to claim 1 wherein the steps of protecting and dyeing said vegetable ivory products are repeated for each selected dye of a color other than said base color applied to said vegetable ivory products.

* * * * *